US007503255B2

(12) United States Patent
Weber et al.

(10) Patent No.: US 7,503,255 B2
(45) Date of Patent: Mar. 17, 2009

(54) SQUEEGEE DEVICE WITH U-SHAPED CARRIAGE

(75) Inventors: Dietmar Weber, Reute (DE); Harry Goetz, Wittenweier (DE)

(73) Assignee: Thieme GmbH & Co. KG, Teningen (DE)

( * ) Notice: Subject to any disclaimer, the term of this patent is extended or adjusted under 35 U.S.C. 154(b) by 284 days.

(21) Appl. No.: 11/402,809

(22) Filed: Apr. 13, 2006

(65) Prior Publication Data

US 2006/0266234 A1 Nov. 30, 2006

Related U.S. Application Data

(60) Provisional application No. 60/684,170, filed on May 25, 2005.

(30) Foreign Application Priority Data

May 25, 2005 (DE) ..... 20 2005 007 281 U

(51) Int. Cl.
*B41L 13/18* (2006.01)

(52) U.S. Cl. ..... 101/123; 101/120

(58) Field of Classification Search ..... None
See application file for complete search history.

(56) References Cited

U.S. PATENT DOCUMENTS

| | | | | | |
|---|---|---|---|---|---|
| 3,828,671 | A | * | 8/1974 | Fuchs | 101/123 |
| 3,889,595 | A | * | 6/1975 | Jaffa | 101/116 |
| 3,943,849 | A | * | 3/1976 | Vasilantone | 101/123 |
| 4,173,185 | A | | 11/1979 | Voegelin | |
| 4,276,826 | A | * | 7/1981 | Bubley et al. | 101/123 |
| 4,779,529 | A | * | 10/1988 | Ericsson | 101/123 |
| 4,995,316 | A | | 2/1991 | Kolblin et al. | |
| 5,421,256 | A | * | 6/1995 | Cutcher | 101/123 |
| 5,438,922 | A | * | 8/1995 | Bubley et al. | 101/123 |
| 5,746,125 | A | | 5/1998 | Tani | |

FOREIGN PATENT DOCUMENTS

| | | |
|---|---|---|
| AT | 215941 | 6/1961 |
| CH | 602 342 A5 | 7/1978 |
| DE | 196 10 273 A1 | 3/1997 |
| EP | 0 315 817 B1 | 10/1988 |
| EP | 0 315 817 B1 | 5/1989 |
| EP | 0 626 259 A1 | 11/1994 |
| JP | 8-187836 A | 7/1996 |
| JP | 2001-287337 A | 10/2001 |

OTHER PUBLICATIONS

German Search report dated Nov. 24, 2005 including English Translation of relevant portion (Nine (9) pages).

* cited by examiner

*Primary Examiner*—Jill E. Culler
(74) *Attorney, Agent, or Firm*—Crowell & Moring LLP

(57) ABSTRACT

Squeegee assembly for a screen printing machine with a printing table, wherein the squeegee assembly has at least one squeegee, one squeegee holder and at least one support displaceable across the printing table, wherein the squeegee is held on the support by means of the squeegee holder and can be pressed against the printing table by pressure cylinders, characterized in that the support has a U-shaped profile, and at least the cylinder sections of the pressure cylinders are accommodated within the U-shaped profile.

25 Claims, 10 Drawing Sheets

SQUEEGEE DEVICE WITH U-SHAPED CARRIAGE

This application claims priority to German patent application no. DE 20 2005 007 281.8, filed May 2, 2005, and the benefit under 35 U.S.C. §119(e) of U.S. provisional patent application Ser. No. 60/684,170, filed May 25, 2005, the disclosures of which are expressly incorporated by reference herein.

BACKGROUND AND SUMMARY OF THE INVENTION

The invention relates to a squeegee assembly for a screen printing machine with a printing table. The squeegee assembly has at least one squeegee, a squeegee holder and at least one carriage that is displaceable across the printing table. The squeegee is held on the carriage by the squeegee holder and can be pressed against the printing table by pressure cylinders. The invention further relates to a screen printing machine with a squeegee assembly according to the invention.

The European Patent EP 0 315 817 B1 discloses a screen printing machine with a printing table and a squeegee that is displaceable across the printing table. A squeegee holder holds the squeegee on a carriage running in guide rails by guides. It is adjustable relative to the printing table in both distance and angle and can be pressed against the printing table. Both ends of the carriage are held directly in the guide rails, and the pressure cylinders are designed as double acting pressure cylinders. A printing angle of the squeegee may be adjusted by pivoting guides at the junction between the squeegee holder and the pressure cylinders. On a side of the carriage opposite the pressure cylinders for the printing squeegee, a flood squeegee may be provided, which can be pressed against the printing table by additional pressure cylinders. The pressure cylinders are each attached to an outer side of the carriage and are longitudinally displaceable in guide rails.

An object of the invention is to provide a compact and reliable squeegee assembly for a screen printing machine.

According to the invention this object is attained by a squeegee assembly for a silk screen printing machine with a printing table, wherein the squeegee assembly has at least one squeegee, a squeegee holder and at least one carriage that is displaceable across the printing table. The squeegee is held on the carriage by the squeegee holder and can be pressed against the printing table by pressure cylinders. The carriage has a U-shaped profile, and at least the cylinder sections of the pressure cylinders are accommodated within the U-shaped profile.

With these measures, at least a part of the pressure cylinders is disposed within the U-shaped profile of the carriage and thereby protected from mechanical damage and dirt. Furthermore, a highly compact design of the carriage is achieved. At the same time, because of the U-shaped cross section of the carriage, the carriage is extremely stable and may be made as an extrusion profile, for example. The very stiff carriage contributes to the high printing precision because the squeegee pressure can be adjusted very precisely.

Electrical and/or pneumatic lines are advantageously run within the U-shaped profile, so that the supply or control lines are also protected from damage and dirt.

An actuator for pivoting the squeegee and/or limiting the stroke of the squeegee may advantageously be arranged within the U-shaped profile section, so that, in the ideal case, the carriage is given a smooth-surfaced exterior, and substantially the entirety of the control and adjustment mechanisms is disposed and protected within the U-shaped profile.

The carriage has advantageously at least one cover plate that covers an open side of the U-shaped profile, such that only the piston rods of the pressure cylinders extend through the cover plate. The cover plate can at the same time be advantageously used as a mounting plate for the pressure cylinders, so that the pressure cylinders can be mounted and adjusted on the cover plate where they are easily accessible, and the cover plate together with the pressure cylinders is then inserted into the U-shaped profile of the carriage. The cover plate in conjunction with the U-shaped profile of the carriage results in an extremely stable configuration of the carriage, which is protected from damage and dirt and is at the same time easy to mount.

The two ends of the at least one carriage are advantageously pivotable relative to the printing table by a respective pivoting assembly.

By this pivoting assembly, different basic positions of the squeegee are approached, for example, a squeegee draining position, a squeegee replacement position and a printing position. Starting from the printing position, the carriage is pivoted, for example, by an approximately 90° angle into a squeegee draining position in which the squeegee is pivoted out of the screen area and over a drainage channel. In a squeegee replacement position, the carriage is pivoted, for example by 160°, so that the squeegee holder is easily accessible from the top to replace the squeegee. Advantageously, at least one of the pivoting assemblies has a first pivoting cylinder for pivoting the at least one carriage about a first angle, for example an angle of between 60° and 120°, to reach a squeegee draining position, and a second pivoting cylinder for pivoting the carriage about a second angle that is different from the first, for example an angle of between 120° and 200°, to reach a squeegee replacement position. By providing separate pivoting cylinders it is possible to keep the control complexity to approach the two different angular positions low and also to realize large pivoting angles without any difficulties.

Advantageously, a printing squeegee carriage and, in parallel thereto, a flood squeegee carriage are provided in the screen printing machine according to the invention. This makes it possible to accommodate and protect the adjustment units also for the flood squeegee within the U-shaped profile of the flood squeegee carriage, for example, pressure cylinders. The two ends of both the flood squeegee carriage and the printing squeegee carriage are advantageously arranged together on a pivoting assembly so as to be pivotable relative to the printing table. The flood squeegee carriage and the printing squeegee carriage are thus pivoted together by means of the pivoting assemblies. Irrespective thereof, each carriage can have a separate actuator to adjust the squeegee angle.

The at least one carriage is adjustable relative to the printing table to adjust a squeegee angle. Thus the adjustment of the squeegee angle for a printing process is done by pivoting the entire carriage. This facilitates the adjustment of the squeegee angle, because the carriage can on the one hand be pivoted using servomotors and on the other hand also from the sides of the printing table. In particular, the operator does not need to bend far across the printing table to reach the adjustment mechanism of the printing squeegee if the printing table is very wide. For the adjustment of the squeegee angle, both ends of the carriage are advantageously held in a slotted link in a holding fixture. A slotted link makes it possible to realize a very large pivoting radius and consequently a very exact squeegee angle adjustment for a printing process. An actuator to adjust the carriage advantageously has a servomotor, a spindle gear and a bevel gear accommodated in the U-shaped profile of the carriage. A drive shaft driven by the servomotor advantageously extends through the slotted link in the holding fixture and is connected to the bevel gear. A spindle of the spindle gear is then connected on the one hand to the holding fixture and on the other hand to the bevel gear and extends, for example, into a spindle bore of a bevel wheel of the bevel gear. This makes it possible to realize a very compact and at the same precisely positionable actuator for the squeegee angle adjustment. Providing the spindle drive makes it possible, for example, to apply even large holding forces during the printing process. Because both ends of the carriage must be adjusted synchronously, a synchronization shaft extending along the carriage between end faces of the carriage is advantageously provided. The synchronization shaft is also advantageously arranged within the U-shaped profile of the carriage.

The squeegee is advantageously held on the carriage by means of a clamping device. The clamping device is actuated by the pressure cylinders. This makes it possible to use the pressure cylinders on the one hand to press the printing squeegee against the printing table or against the printing screen and on the other hand to release or clamp the squeegee at the same time. Advantageously, the clamping device can be actuated in an extreme position of the pressure cylinder, such that a clamping lever of the clamping device strikes a limit stop on the carriage in the extreme position. The squeegee is pressed against the printing screen in an adjustment range that does not include the extreme position of the pressure cylinders. When the pressure cylinder is then moved into the extreme position, for example, into the fully retracted position, a clamping lever of the clamping device strikes a limit stop on the carriage and thereby releases the clamping device. The clamping lever is advantageously configured as a double-armed toggle lever and, in the end position of the pressure cylinders or their piston rods when they are retracted into the carriage, is pushed into a release position by the limit stop provided on the carriage. Providing a toggle lever makes it possible to realize very large clamping forces.

Advantageously, the carriages provided are a printing squeegee carriage and, in parallel thereto, a flood squeegee carriage. Adjustable limit stops are provided in the flood squeegee carriage to limit the stroke of the flood squeegee relative to the printing table. Advantageously, the one or more limit stops in the central area of the printing table can be adjusted independently from the limit stops in the edge area of the printing table. This enables a so-called cambering, which corresponds to a downward deformation of the squeegee in the center of the printing table to compensate any sagging of the screen fabric in large printing screens. The limit stops are advantageously adjustable by means of a stroke limiting device, which is arranged within the U-shaped profile of the flood squeegee carriage and has a servomotor and an opposite limit stop that can be displaced in a slotted link. Using an opposite limit stop displaceable in a slotted link makes it possible to achieve a highly precise adjustment of the opposite limit stop and, moreover, also to apply very large counterforces.

When the squeegee is lifted or pressed down during the printing process, for example, only sufficient pressure to lift the squeegee is applied to the pressure cylinders. This pressure can be approximately 2 bar, for example. On the other hand, to overcome a spring force of the toggle lever for opening, it is necessary to overcome the bias of the spring. To release the clamping device of the printing squeegee, the pressure in the pressure cylinders is then increased to 6 bar, for example.

Other objects, advantages and novel features of the present invention will become apparent from the following detailed description of the invention when considered in conjunction with the accompanying drawings for example.

DETAILED DESCRIPTION

Figure 1:
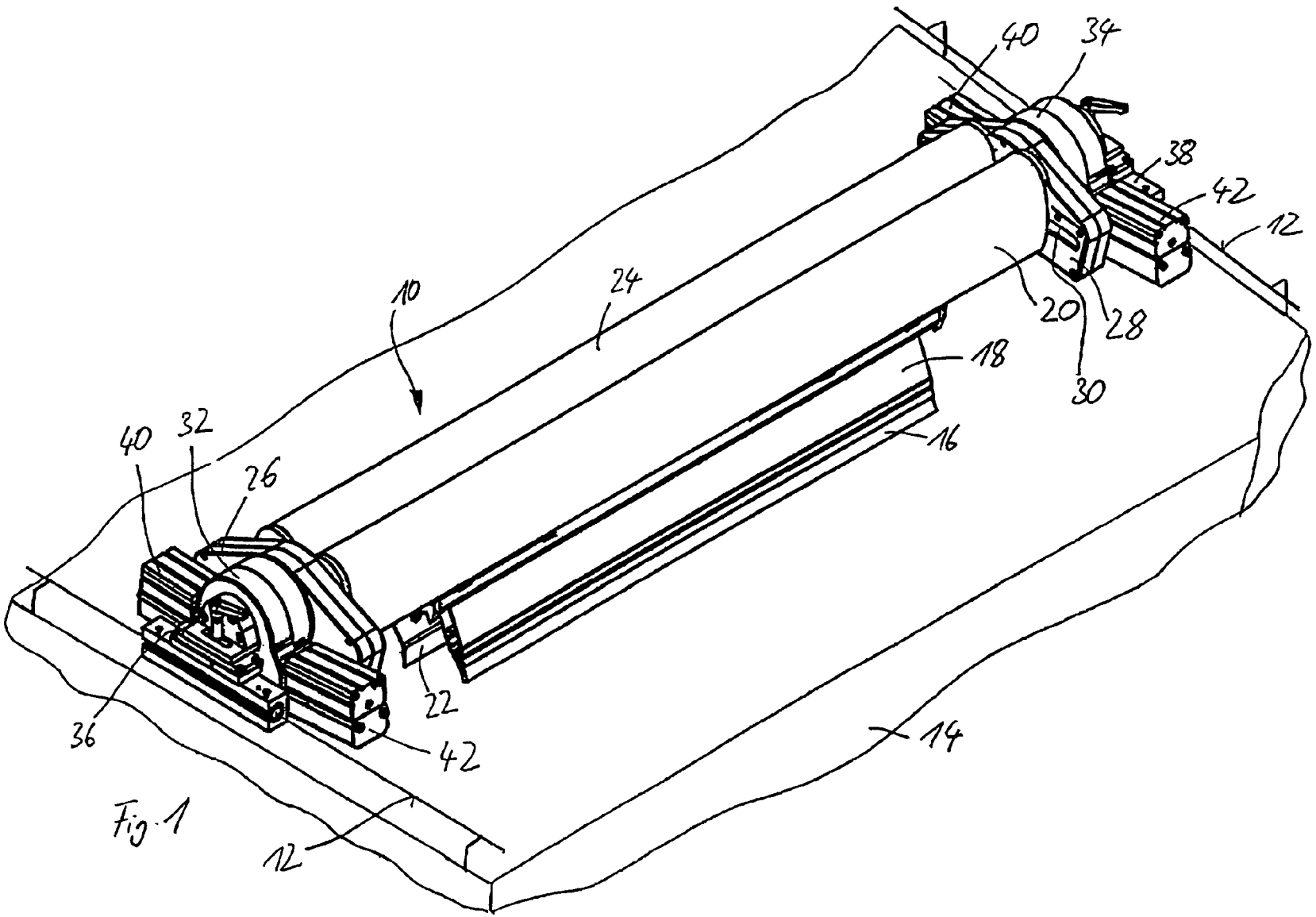
FIG. 1 is a perspective view of an embodiment of a screen printing machine according to the invention.

In the representation of FIG. 1, a screen printing machine is depicted schematically with only the squeegee assembly 10 being shown non-schematically. The squeegee assembly 10 can be displaced across a printing table 14 along guide rails 12. A printing screen (not depicted) may be arranged above the printing table 14 in a manner known per se, and a sheet of paper, for example, lying on the printing table 14 is printed with the ink pressed through the printing screen as the squeegee assembly 10 moves across the printing table 14. The schematically indicated guide rails 12 are spaced at a distance above the printing table 14. The squeegee assembly 10 is moved along the guide rails 14 by means of a drive (not depicted).

The squeegee assembly 10 for the screen printing machine has a printing squeegee 16 mounted to a squeegee holder 18, which in turn is connected to a printing squeegee carriage 20. In addition, a flood squeegee 22 is provided, which is disposed on a flood squeegee carriage 24. The printing squeegee carriage 20 and the flood squeegee carriage 24 each have a U-shaped cross section and together are attached at their two ends to a respective holding fixture 26, 28. The printing squeegee carriage 20 is pivotable relative to the holding fixtures 26, 28. The two ends of the printing squeegee carriage 20 are moved in slotted links 30 in the holding fixture 26 or 28. The flood squeegee carriage 24 is likewise pivotable relative to the holding fixtures 26, 28.

The holding fixtures 26, 28, in turn, are each connected to guide pieces 36, 38 running on the guide rails 12 by a pivoting assembly 32, 34. The pivoting assemblies 32, 34 are used to pivot the holding fixtures 26, 28 relative to the guide rails 12 or the printing table 14. Thus, as the holding fixtures 26, 28 are pivoted, the printing squeegee carriage 20 and the flood squeegee carriage 24 are pivoted together. The pivoting assemblies 32, 34 each have two pivoting cylinders 40, 42. The first pivoting cylinders 40 are used to pivot the holding fixtures 26, 28 about an approximately 90° angle starting from the printing position illustrated in FIG. 1. Pivoting the holding fixtures 26, 28 by 90° makes it possible to swing the printing squeegee 16 over a drainage channel (not depicted). The second pivoting cylinders 42 are used to pivot the holding fixtures 26, 28 by approximately 160° starting from the position illustrated in FIG. 1 into a squeegee replacement position. After being pivoted by approximately 160°, the flood squeegee 22 and the printing squeegee 16 are accessible from the top and can thus be easily replaced.

Thus, the pivoting assemblies 32, 34 are provided for pivoting the printing squeegee carriage 20 and the flood squeegee carriage 24 into a drainage position or a squeegee replacement position and cover a comparatively large pivoting angle. The pivoting of the printing squeegee carriage 20 or the flood squeegee carriage 24 by displacement in the slotted links 30 in the holding fixtures 26, 28, on the other hand, serves to precisely adjust a squeegee angle and therefore covers a much smaller angular range.

It is evident from FIG. 1 that the squeegee assembly 10 has a smooth surface overall and, in particular, the adjustment mechanism for the printing squeegee 16 and the flood squeegee 22 are accommodated completely within the printing squeegee carriage 20 and the flood squeegee carriage 24. Electrical and pneumatic lines are also run inside the printing carriage 20 and the flood squeegee carriage 24. This results in a very compact design overall, in which the mechanical and electrical components are largely accommodated within the U-shaped profile of the printing squeegee carriage 20 and the flood squeegee carriage 24, so that they are reliably protected from damage.

Figure 2B:
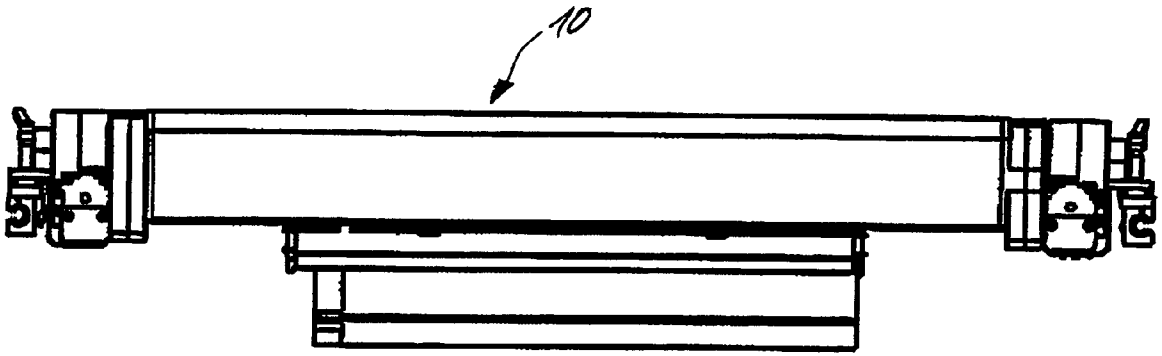
FIGS. 2*a*, 2*b* and 2*c* show a side view, a front view and a top view, respectively, of the squeegee assembly of the screen printing machine depicted in FIG. 1.
Figure 2C:
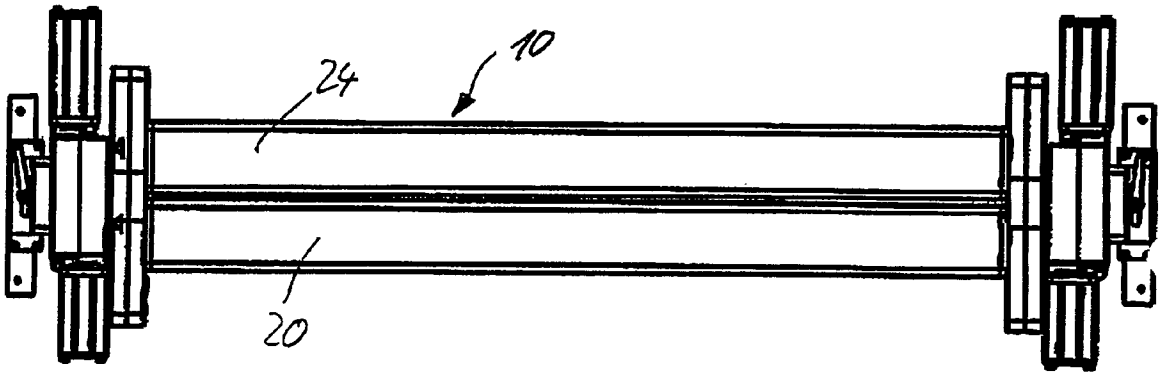
Figure 2A:
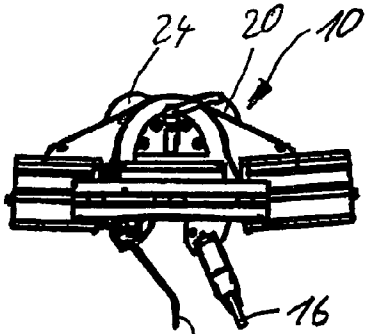

The compact and smooth-surfaced design of the squeegee assembly 10 is also evident in FIGS. 2*a*, 2*b* and 2*c*. The printing squeegee 16 and the flood squeegee 22 are clearly visible in FIG. 2*a*. The printing squeegee 16 is arranged essentially below the printing squeegee carriage 20 and is pressed against the printing table 14 by means of pressure cylinders (not shown in FIG. 2*a*), which are disposed within the printing squeegee carriage 20. The flood squeegee 22 is arranged essentially below the flood squeegee carriage 24 and is likewise adjusted by pressure cylinders (not shown in FIG. 2*a*) that are disposed within the flood squeegee carriage 24.

Figure 3A:
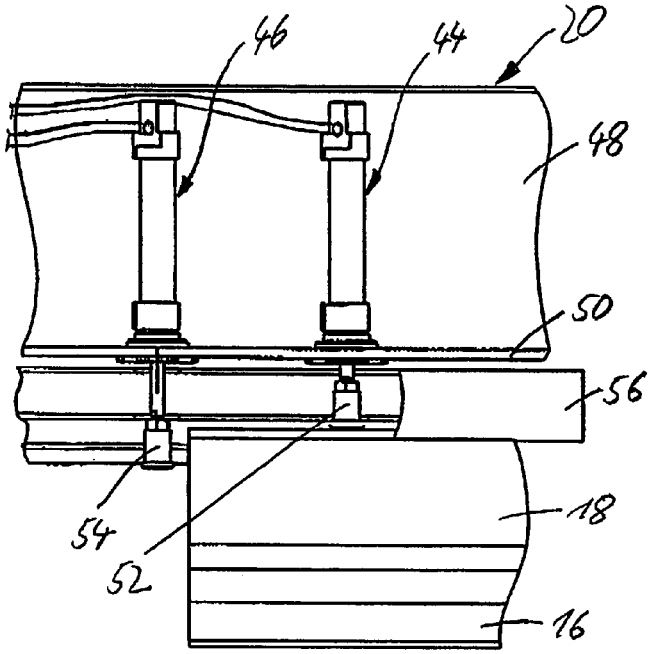
FIG. 3*a* is a partially cutaway side view of a printing squeegee carriage shown in FIG. 1.
Figure 3B:
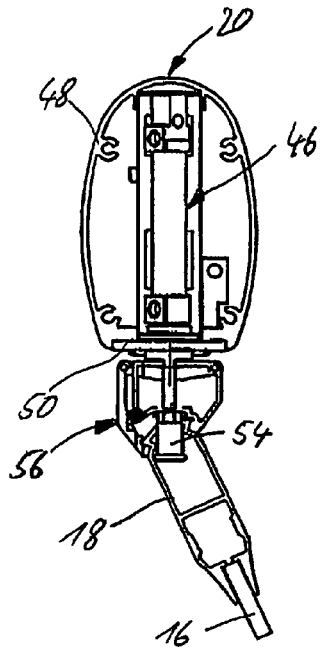
FIG. 3*b* is a cross sectional view perpendicular to the longitudinal direction of the printing squeegee carriage of FIG. 3*a*, FIGS. 4*a* and 4*b* are cross sectional views of a flood squeegee carriage depicted in FIG. 1 in different operating positions.

FIGS. 3*a* and 3*b* show the printing squeegee carriage 20 in two different side views. FIG. 3*a* is a section in longitudinal direction of the printing squeegee carriage 20, whereas FIG. 3*b* is a section in transverse direction.

FIG. 3*a* clearly shows that the cylinder sections of the pressure cylinders 44, 46 are accommodated completely within a U-shaped profile 48 of the printing squeegee carriage 20. The pneumatic supply lines for the pressure cylinders 44, 46 also extend within the U-shaped profile 48. At its open longitudinal side, the U-shaped profile 48 is sealed by a cover plate 50. The pressure cylinders 44, 46 are attached to the cover plate 50 and only the piston rods of the pressure cylinders 44, 46 extend through the cover plate 50. FIG. 3*b* shows that the pressure cylinders 44, 46 are connected to the cover plate 50 on the one hand and with their end opposite the cover plate 50 fit into a correspondingly adapted support in the U-shaped profile 48 on the other hand. The pressure cylinders 44, 46 are thus held very stably inside the printing squeegee carriage 20.

In FIG. 3*a* it may be seen that the pressure cylinders 44, 46 are spaced at a close distance from one another on the cover plate 50 and are each provided with a thrust member 52, 54. FIG. 3*a* shows only two pressure cylinders 44, 46. Corresponding pressure cylinders 44, 46, however, are provided within the printing squeegee carriage 20 over substantially the entire length of the pressure squeegee carriage 20. In FIG. 3*a* only the thrust member 52 of the pressure cylinder 44 is connected above the squeegee holder 18 of the printing squeegee 16. By adjusting the air pressure in the pressure cylinder 44, a squeegee pressure may be set. To apply pressure to the printing squeegee 16, the thrust member 52 of the pressure cylinder 44 pushes against the topside of the squeegee holder 18, which is configured as a clamping profile for the printing squeegee 16. The squeegee holder 18, in turn, is held on the printing squeegee carriage 20 by a clamping device 56. In FIG. 3*a* the clamping device 56 is partly cut away and is configured in such a way that the thrust members 52, 54 can be moved by a certain distance relative to the clamping device 56 but hold the clamping device captive. If the length of the squeegee holder 18 and the printing squeegee 16 is dimensioned such that no squeegee holder 18 exists underneath a pressure cylinder, as illustrated in FIG. 3*a*, 3*b* by means of the pressure cylinder 46, the piston rod together with the thrust member 54 of the pressure cylinder 46 affixed thereto moves through an opening of the clamping device 46 into the open space and thus applies no additional and undesirable pressure force to the printing squeegee 16.

Figure 4A:
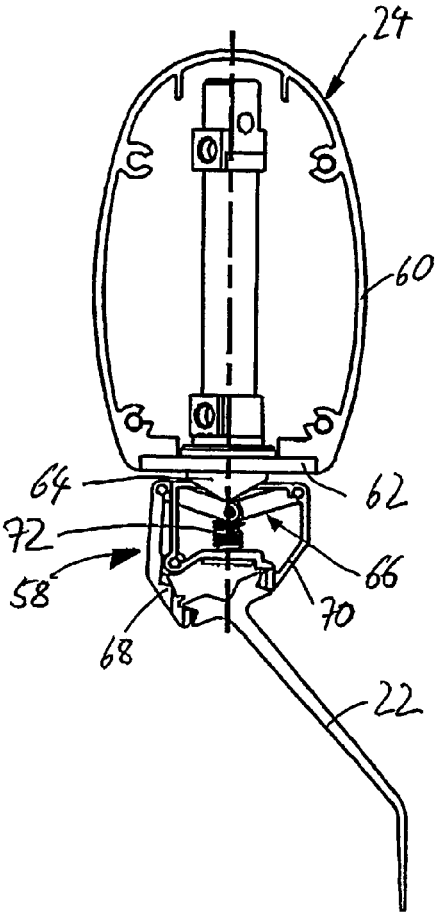
Figure 4B:
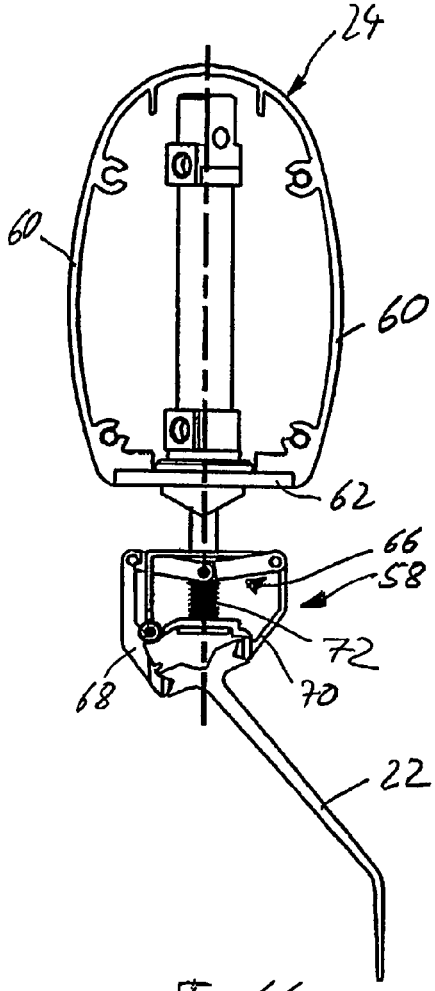

FIGS. 4*a* and 4*b* are sectional views of the flood squeegee carriage 24 in two different operating positions. FIG. 4*a* shows a state where a clamping device 58, which is configured analogously to the clamping device 56 of FIG. 3*a*, 3*b*, is moved into a release position, such that the flood squeegee 22 can be removed from the clamping device 58. FIG. 4*b* shows an operating state in which the clamping device 58 reliably holds the flood squeegee 22 and is in a clamping position. Analogous to the fastening of the flood squeegee 22 in the clamping device 58, the squeegee holder 18 is secured in, or released from, the clamping device 56 shown in FIG. 3*a*, 3*b*.

In FIG. 4*a*, 4*b* it may be seen that the flood squeegee carriage 24 is configured identically to the printing squeegee carriage 20 and has a U-shaped profile 60 and a cover plate 62 sealing the open side of the U-shaped profile 60. A thrust bearing 64 with a V-shaped face opposite the U-shaped profile 60 is disposed on the cover plate 62 outside the U-shaped profile 60. In FIG. 4*a*, the thrust bearing 64 pushes a double-armed toggle lever 66 of the clamping device 58 such that the apex of the V-shaped face of the thrust bearing 64 presses against the junction of the two arms of the toggle lever 66. The toggle lever 66 pivots a clamping bar 68 relative to a clamping profile 70, such that a distance between opposite clamping projections of the clamping lever 68 and the clamping profile 70 is increased and the flood squeegee 22 can be released.

In FIG. 4*b*, the toggle lever 66 is spaced apart from the thrust bearing 64 and is therefore pushed into a closed position by a pressure spring 72, in which the clamping projections of the clamping lever 68 are pushed toward the opposite clamping projection of the clamping profile 70. Thus, a clamping force applied to the flood squeegee 22 is transmitted by the pressure spring 72 to the toggle lever 66, which in turn pivots the clamping lever 68 relative to the clamping profile 70 and thereby applies the clamping force to the flood squeegee 22.

The position shown in FIG. 4*a* is achieved by complete retraction of the pressure cylinder. The cylinder pressure required to overcome the spring resistance of the spring 72 is 6 bar, for example. The position shown in FIG. 4*b* is achieved after at least a partial extension of the pressure cylinder. To press the flood squeegee 22 against the printing screen, a cylinder pressure of approximately 2 bar is sufficient.

Figure 5:
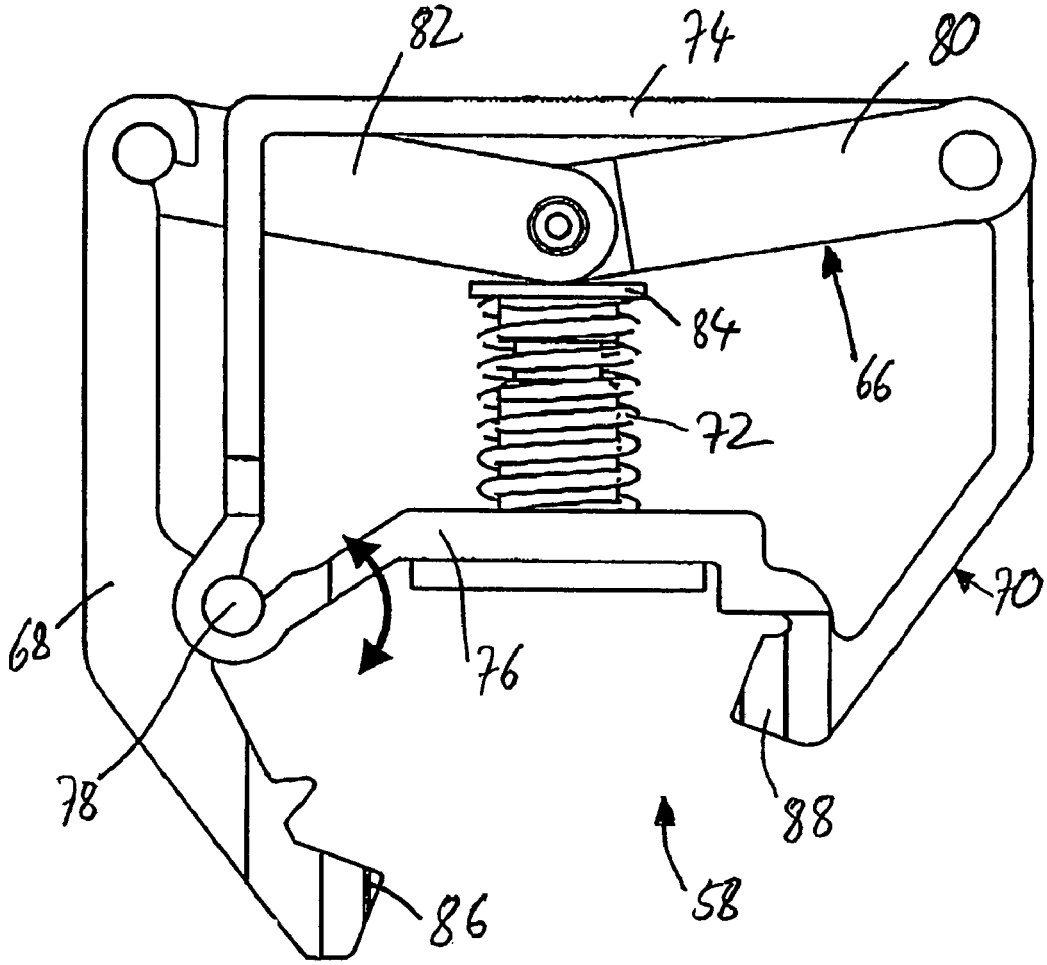
FIG. 5 is an enlarged representation of a clamping device shown in FIG. 4*b*.

FIG. 5 shows the clamping device in greater detail. As already mentioned above, the clamping device 58 is configured identically to the clamping device of FIG. 3*a*, 3*b*. The clamping profile 70 has a closed cross section. As explained with reference to FIG. 3*a*, 3*b*, it is provided with openings in its upper wall 74, which are dimensioned to allow the piston rods of the pressure cylinders to run through them, while the thrust members at the end of the piston rods cannot slip through the openings and therefore hold the clamping profile 70 on the flood squeegee carriage 24 or the printing squeegee carriage 20. Opposite the openings in the topside 74, slightly larger openings are formed in a bottom side 76 through which the thrust members of the pressure cylinders can pass. Thus the clamping profile 70 can be pulled by the pressure cylinders against an associated carriage, e.g., against the flood squeegee carriage 24. Conversely, as the pressure cylinder is extended, the clamping device 58 is moved away from the associated carriage. This makes it possible to reach the different operating positions illustrated in FIG. 4*a*, 4*b*. The clamping profile 70 may be described as a fixed part in relation to the clamping device 58, since the clamping lever 68 is pivotable relative to the clamping profile 70. The clamping lever 68 is pivoted about a bearing axis 78 as indicated by the double arrows. A first arm 80 of the toggle lever 66 is pivotably mounted to the clamping profile 70. A second arm 82 of the toggle lever 66 is pivotably mounted to the clamping lever 68. The two arms 80, 82 are furthermore flexibly connected to each other, such that the flexible connection of the arms 80, 82 is arranged above a thrust member 84 that is biased upwardly by the pressure spring 72, from the underside 76 of the clamping profile 70 in the direction of its top side 74. Through the action of the pressure spring 72, the flexible connection of the arms 80, 82 of the toggle lever 66 is thus shifted upwardly as seen in FIG. 5, so that the upper end of the clamping lever 68 is deflected towards the left as seen in FIG. 5 and the clamping projection 86 at the opposite end of the clamping lever 68 will consequently move towards the clamping projection 88 of the clamping profile 70. Thus, the squeegee holder 18, or the flood squeegee 22 directly, can be clamped between the clamping projections 86, 88.

If, on the other hand, the clamping device 58 is moved towards the associated carriage because the pressure cylinders are being retracted, as illustrated in FIG. 4*a*, the thrust bearing 64 depicted in FIG. 4*a*, 4*b* pushes the central area of the toggle lever 66 against the action of the pressure spring 72 in downward direction as seen in FIG. 5, such that the junction of the arm 82 with the clamping lever 68 is moved to the right as seen in FIG. 5. As a result, the clamping projection 86 moves away from the clamping projection 88 of the clamping profile 70 and the squeegee holder 18 or the flood squeegee 22 is released.

It should be noted that the pressure cylinders are used on the one hand to move the printing squeegee 16 or the flood squeegee 22 towards or away from the printing table. The pressure cylinders can also press a printing squeegee 16 or the flood squeegee 22 against a printing screen. Finally, the pressure cylinders are also used to release a clamping of the squeegee holder 18 or the flood squeegee 22, as described above. This substantially simplifies the construction according to the invention of the squeegee assembly as a whole.

Figure 6:
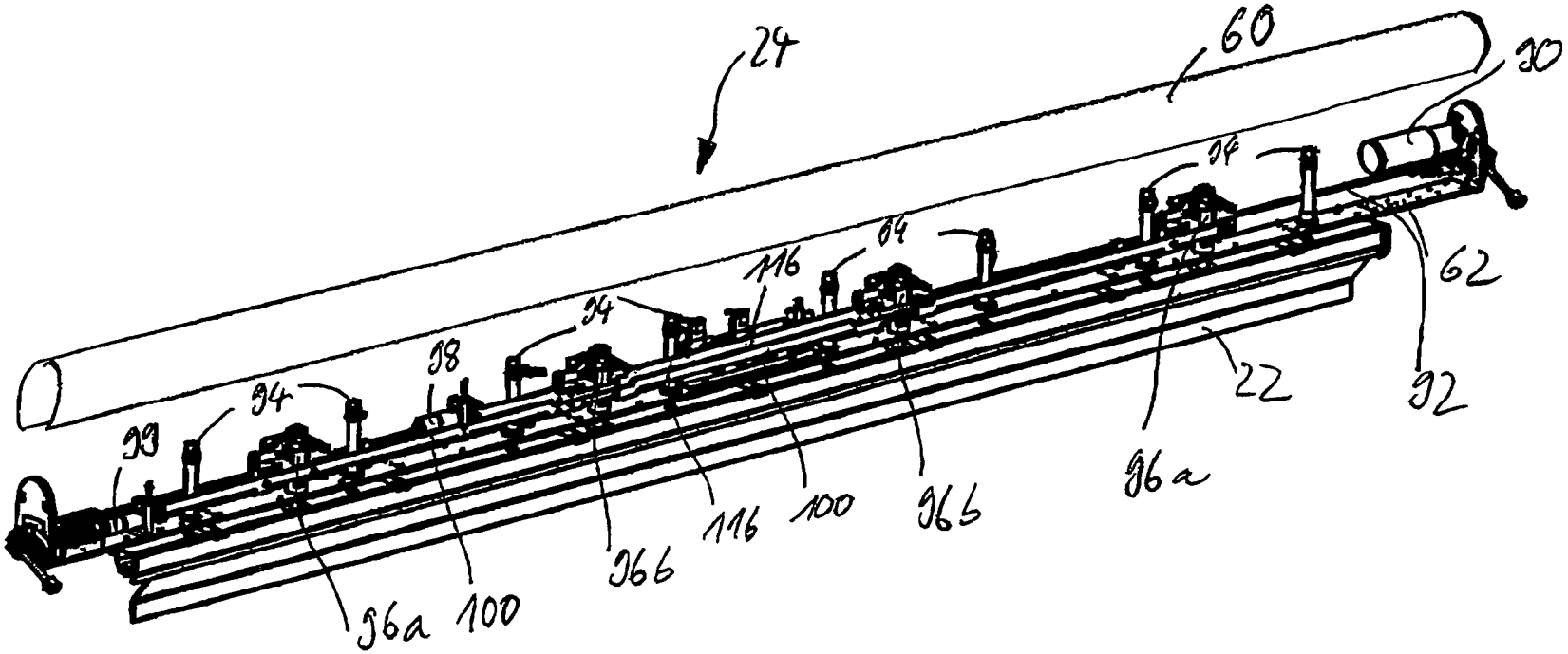
FIG. 6 is a perspective view of the printing squeegee carriage of FIG. 1 in an exploded view.

FIG. 6 shows the flood squeegee carriage 24 in an exploded view. As may be seen in FIG. 6, all the functional units are attached to the cover plate 62, and the cover plate 62, including the attached functional units, is then inserted into the U-shaped profile 60. This creates a highly compact carriage, in the interior of which all the functional units and the electrical and pneumatic supply and control lines are protected from dirt and damage.

The cover plate 62 is provided with a face plate at each end of the carriage 24. A servomotor 90 provided for adjusting the squeegee angle is mounted to the right face plate as seen in FIG. 6. The actuator for adjusting the squeegee angle will be described in greater detail with reference to FIG. 7. The servomotor 90 drives a synchronization shaft 92, which extends through the carriage 24 to the opposite face plate, where it causes a synchronous adjustment of the carriage 24. FIG. 6 further shows a total of eight pressure cylinders 94 mounted to the cover plate 62 so that they are spaced at equal intervals.

A total of four stroke limiting devices 96, 96*b* are furthermore shown, each of which is associated with a limit stop to limit the stroke of the flood squeegee 22. The stroke limiting devices 96*a* can be adjusted by a common servomotor 99, while the stroke limiting devices 96*b* can be adjusted by a common servomotor 98. The stroke limiting devices 96*a* are intercoupled by a push rod 100, whereas the stroke limiting devices 96*b* are intercoupled by a push rod 116. The two central stroke limiting devices 96*b* can be adjusted independently from the two outer stroke limiting devices 96*a* to obtain a cambering of the squeegee over the length of the carriage 24. This cambering, which corresponds to a deflection of the squeegee in the direction towards the printing table, makes it possible to compensate any sagging of the printing screen if the printing widths are very large. The stroke limiting devices 96*a*, 96*b* will be described in greater detail with reference to FIG. 8.

Figure 7:
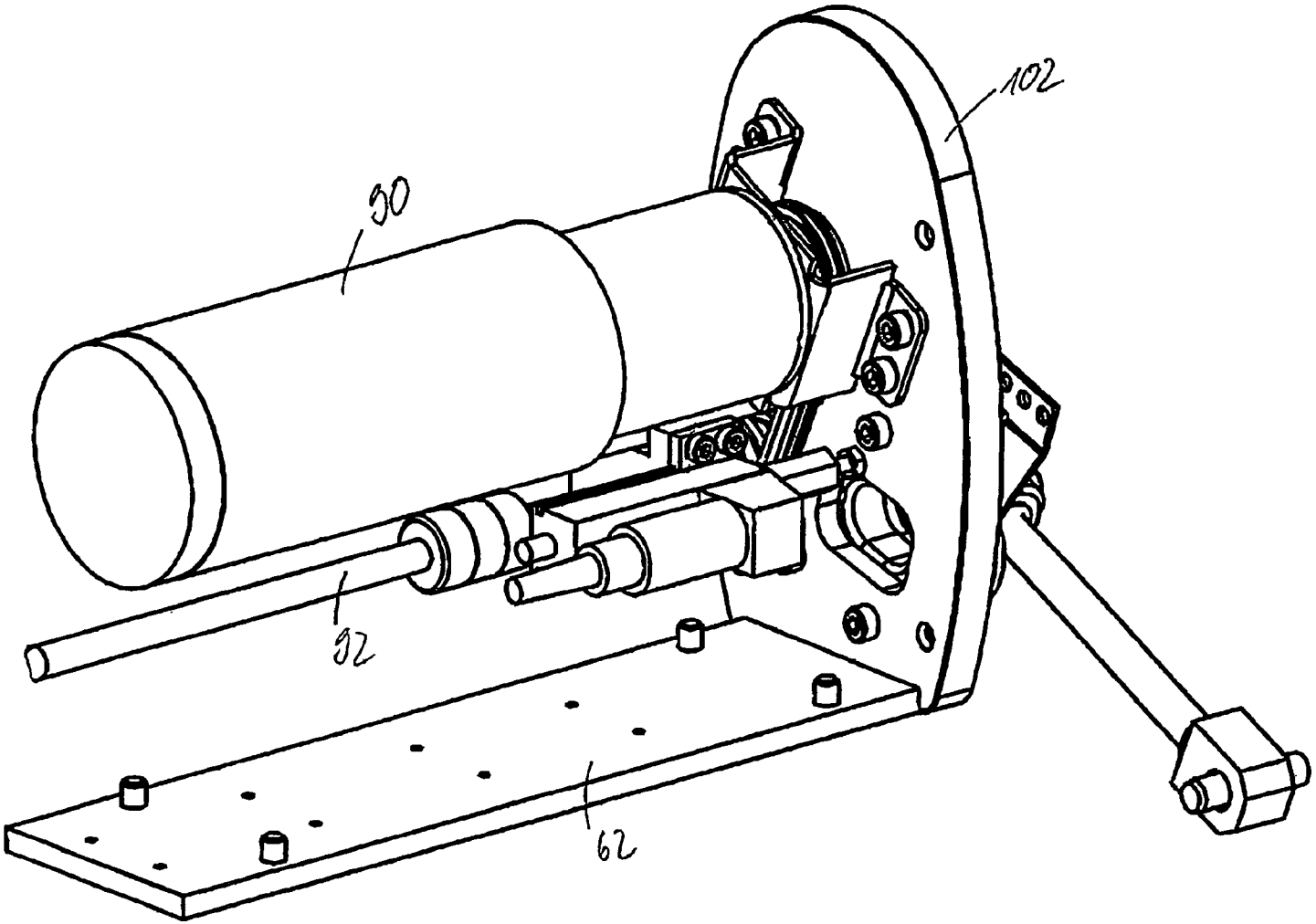
FIG. 7 is an enlarged representation of a detail of the squeegee carriage of FIG. 6.

FIG. 7 shows the actuator for pivoting the carriages 20, 24 relative to the holding fixtures 26, 28 as shown in FIG. 1. The actuator has a servomotor 90 that is attached to a face plate 102, which in turn is connected to the cover plate 62. Via a driving belt, the servomotor 90 drives a drive shaft, which on the one hand is connected to the synchronization shaft 92 and on the other hand extends through the slotted link 30 in the holding fixture 26, as may be seen in FIG. 10. As explained above, the synchronization shaft extends through the carriage and drives an adjustment unit on the opposite face plate. As shown in FIG. 7, the essential components of the actuator 90 are accommodated within the carriage where they are protected.

Figure 10:
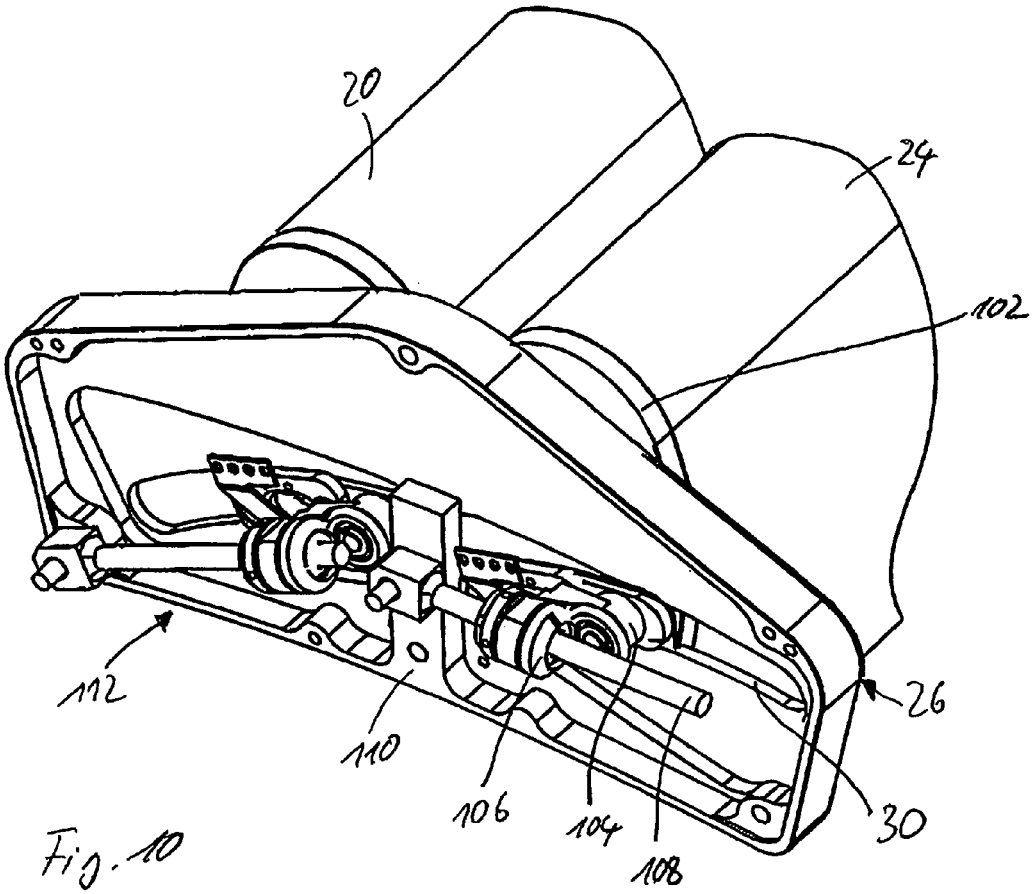
FIG. 10 is an enlarged representation of a detail of FIG. 9.

As may be seen in FIG. 10, the drive shaft driven by the servomotor 90 is connected to a bevel gear, which has a first bevel wheel 104 and a second bevel wheel 106. A spindle 108 of a spindle gear extends through the second bevel wheel 106. For example, a concentric bore is provided in the second bevel wheel 106 with an internal thread that is adapted to the spindle 108. One end of the spindle 108 is free, while the opposite end is flexibly supported on a first half-shell 110 of the holding fixture 26.

If the servomotor drives the drive shaft, the first bevel wheel 104, and consequently also the second bevel wheel 106, rotates. The second bevel wheel 106 thus moves towards or away from the free end of the spindle 108, depending on the direction of rotation. The bevel gear and hence also the face plate 102 and the entire flood squeegee carriage 24 are pivoted along the slotted link 30 together with the second bevel wheel. The spindle gear, consisting of the spindle 108 and the bevel wheel 106, can apply very large holding forces, making it possible to withstand even high driving forces at the printing squeegee 16 or the flood squeegee 22 without the risk of altering the squeegee angle.

A bevel gear and spindle gear with essentially the same construction are part of an actuator 112 with which the angle of the printing squeegee 16 is adjusted by pivoting the printing squeegee carriage 20 relative to the holding fixture 26.

Figure 9:
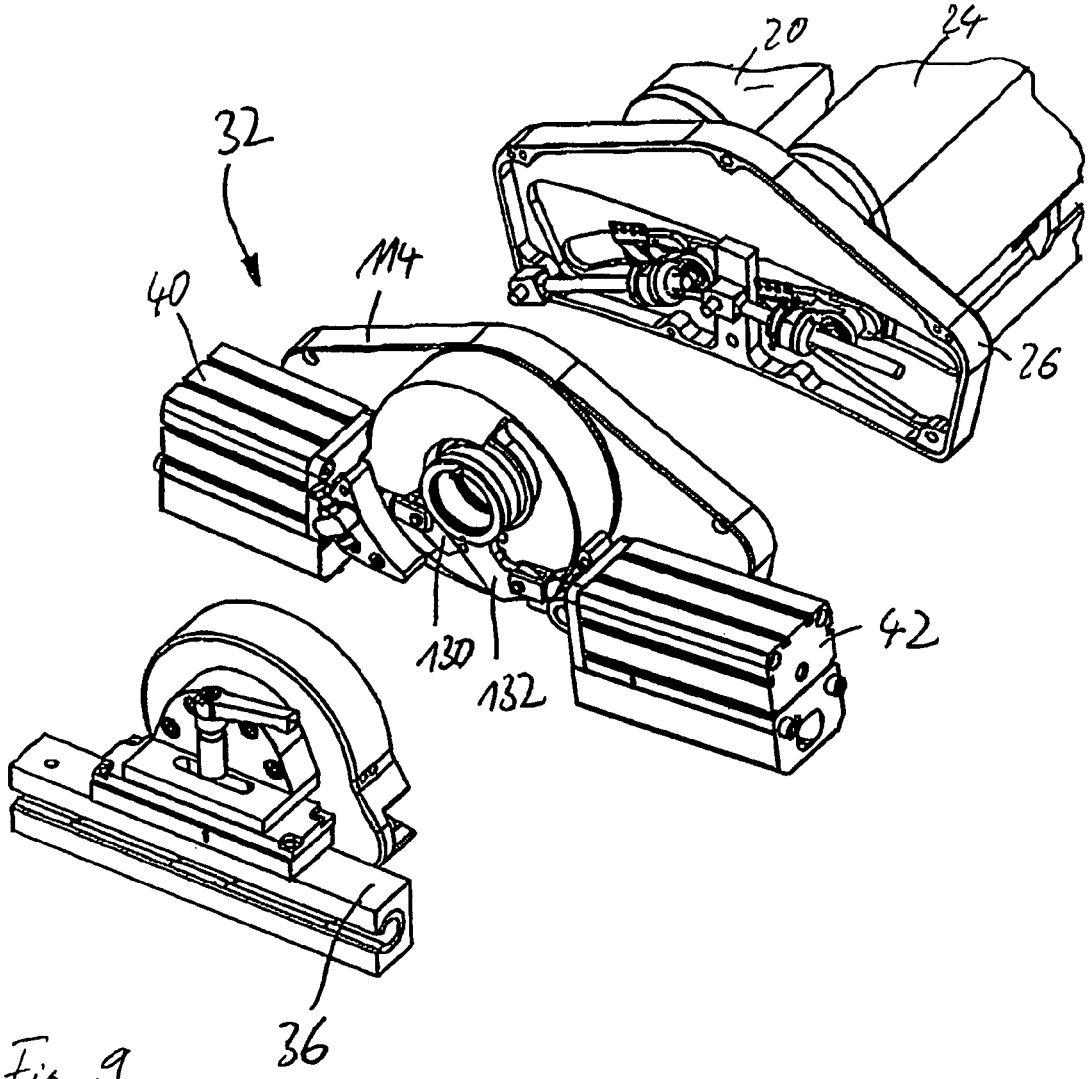
FIG. 9 is an exploded partial view of the squeegee assembly shown in FIG. 1.

As may be seen in FIG. 9, the holding fixture 26 has not only a lower shell 110 but also an upper shell 114, which in conjunction with the lower shall 110 forms a substantially closed housing to receive and protect the spindle gear and bevel gear for the adjustment of the squeegee angle.

Figure 8:
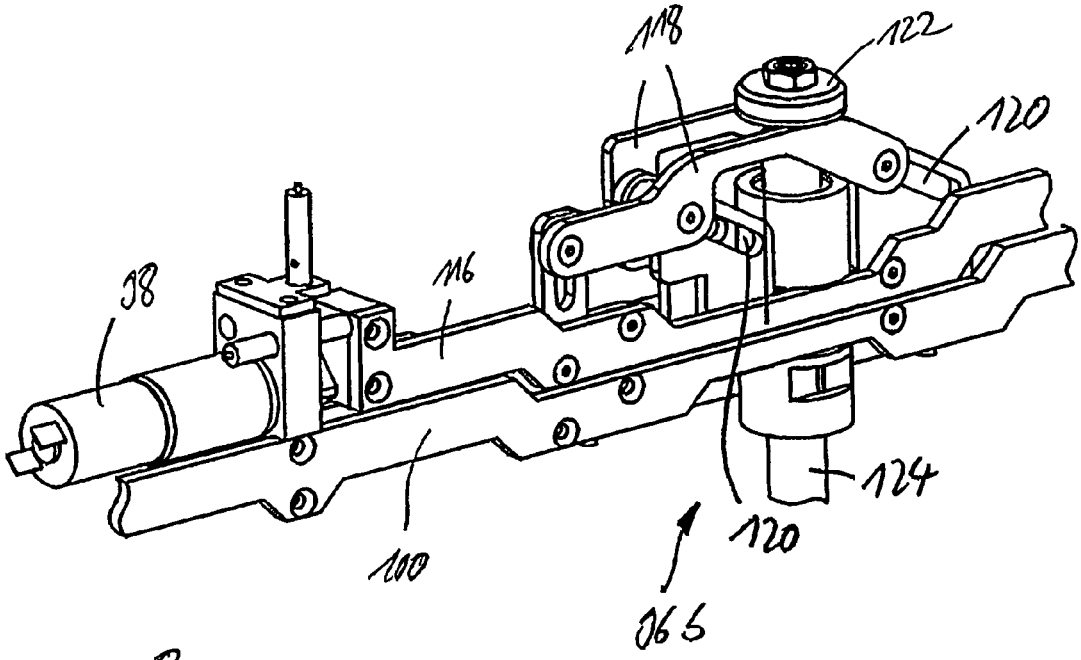
FIG. 8 is another enlarged representation of a detail of the printing squeegee carriage of FIG. 6.

FIG. 8 illustrates one of the stroke limiting devices 96*b* of FIG. 6 in greater detail. The stroke limiting device 96*b* limits the stroke of the flood squeegee 22 relative to the printing screen. This makes it possible to define the parameter of the overpressing of the flood squeegee 22 relative to the printing screen. The stroke limiting device 96*b* has the push and pull rod 116, which is moved by the servomotor 98 parallel to the longitudinal direction of the carriage. An opposite limit stop 118 is mounted to the pull rod 116 so that it is height-adjustable relative to the pull rod, but is pulled along by the pull rod 116 in longitudinal direction. To this end, the opposite limit stop 118 is connected to the pull rod 116 by an oblong hole, which extends perpendicularly to the direction of movement of the pull rod 116. The opposite limit stop 118 is guided in two slotted links 120, which are fixed relative to the carriage and extend at an angle to the longitudinal direction of the carriage. When the pull rod 116 moves parallel to the carriage, the opposite limit stop 118 moves along the slotted links 120 and changes its distance relative to the cover plate of the carriage. A limit stop washer 122 is seated against the opposite limit stop 118 and is in turn coupled to a connecting rod 124 that is guided in the carriage and connected to the clamping device 58 for clamping the flood squeegee 22. Thus, the flood squeegee 22 together with the clamping device 58 can be moved downwardly by the pressure cylinder in the direction of the printing table until the limit stop washer 122 strikes the opposite limit stop 118. To change the end position of the flood squeegee that is then reached relative to the carriage, the servomotor 98 can be actuated to change the distance of the opposite limit stop 118 relative to the cover plate of the carriage by means of the pull rod 116.

As explained above with reference to FIG. 6, two outer stroke limiting devices 96*a* and two inner stroke limiting devices 96*b* are provided. The pull rod 116 extends from the servomotor 98 up to the additional inner stroke limiting device 96*b*, such that the two inner stroke limiting devices 96*b* can be adjusted together. On the other hand, the pull rod 100, only a part of which is shown in FIG. 8, connects the two outer stroke limiting devices 96*a* and is displaced by means of the additional servomotor 99. The two outer stroke limiting devices 96*a* can thus also be adjusted together. The important thing is that the two inner stroke limiting devices 96*b* can be controlled independently of the two outer stroke limiting devices 96*a* to enable a cambering of the squeegee over the length of the carriage.

In addition to the adjusting drive of the carriages 20, 24 relative to the holding fixture 26, which was already explained above, FIG. 9 also illustrates the pivoting assembly 32 of FIG. 1 in greater detail. The pivoting assembly 32 is constructed on the upper shell 114 of the holding fixture 26 and has the two pivoting cylinders 40, 42. The pivoting cylinder 40 engages with a pivoting lever 130 that encompasses a pivoting axis and engages with the upper shell 114. The pivoting cylinder 42 engages with a pivoting lever 132, which likewise engages with the upper shell 114. The pivoting levers 130, 132 can engage with slotted links in the upper part 114 by means of pins, for example, to realize the different pivot angles caused by the pivoting cylinders 40 and 42.

Both carriages 20, 24 are thus pivotably connected to the guide piece 36 by means of the holding fixture 26 and can on the one hand be pivoted relative to the holding fixture 26 to adjust a squeegee angle. On the other hand, they can be pivoted together with the holding fixture 26 by the pivoting drive 32 about two different angles relative to the guide piece 36 and thus the guide rail 12 and the printing table 14.

The foregoing disclosure has been set forth merely to illustrate the invention and is not intended to be limiting since modifications of the disclosed embodiments incorporating the spirit and substance of the invention may occur to persons skilled in the art, the invention should be construed to include everything within the scope of the appended claims and equivalents thereof.

What is claimed is:

1. A squeegee assembly for a screen printing machine with a printing table, comprising:

a squeegee;

a squeegee holder;

a carriage displaceable across the printing table; and at least one pressure cylinder carried on the carriage, wherein the squeegee is held on the carriage by the squeegee holder, each of the at least one pressure cylinders is arranged to press the squeegee against the printing table, the carriage has a U-shaped profile, electrical and/or pneumatic lines are arranged within the U-shaped profile, and at least the cylinder section of each of the at least one pressure cylinders is accommodated within the U-shaped profile, further comprising:

an actuator for at least one of pivoting and limiting a stroke of the squeegee arranged within the U-shaped profile section.

2. The squeegee assembly as claimed in claim 1, wherein the at least one carriage has a cover plate, which covers an open side of the U-shaped profile, such that only the piston rods of the pressure cylinders extend through the cover plate.

3. A squeegee assembly as claimed in claim 1, further comprising a pivoting assembly at each of the two ends of the carriage, the pivoting assemblies arranged to pivot the carriage relative to the printing table.

4. The squeegee assembly as claimed in claim 3, wherein at least one of the pivoting assemblies has a first pivoting cylinder for pivoting the carriage about a first angle and a second pivoting cylinder for pivoting the carriage about a second angle, which differs from the first angle.

5. The squeegee assembly as claimed in claim 4, wherein the carriage is pivotable into a squeegee drainage position by the first pivoting cylinder by an angle of 60 degrees to 120 degrees, and into a squeegee replacement position by the second pivoting cylinder by an angle of 120 degrees and 200 degrees.

6. The squeegee assembly as claimed in claim 1, wherein the carriage is a first carriage, the squeegee assembly further comprising:

a second carriage, wherein the first carriage is a printing squeegee carriage, and the second carriage is a flood squeegee carriage arranged parallel to the printing squeegee carriage.

7. The squeegee assembly as claimed in claim 6, wherein the ends of the flood squeegee carriage and the printing squeegee carriage are arranged together, the squeegee assembly further comprising:

a pivoting assembly at each end of the carriages, each pivoting assembly arranged so as to be pivot the carriages relative to the printing table.

8. The squeegee assembly as claimed in claim 6, wherein at least one adjustable limit stop is provided in the flood squeegee carriage for limiting a stroke of at least one pressure cylinder in the flood squeegee relative to the printing table.

9. The squeegee assembly as claimed in claim 8, wherein the at least one limit stops in a central area of the flood squeeze carriage are adjustable independently of limit stops in the edge area of the flood squeeze carriage.

10. The squeegee assembly as claimed in claim 8 wherein at least one of the at least one limit stops is adjustable by means of a limit stop actuator.

11. Squeegee assembly as claimed in claim 10, wherein the limit stop actuator is disposed within the U-shaped profile of the flood squeegee carriage.

12. The squeegee assembly as claimed in claim 10, wherein the limit stop actuator has a servomotor and an opposite limit stop displaceable in a slotted link.

13. The squeegee assembly as claimed in claim 1, wherein the carriage is adjustable relative to the printing table to set a squeegee angle.

14. The squeegee assembly as claimed in claim 13, further wherein the actuator includes a servomotor.

15. The squeegee assembly as claimed in claim 14, wherein the actuator for adjusting the carriage has a spindle gear.

16. The squeegee assembly as claimed in claim 15, wherein the actuator for adjusting the carriage has a bevel gear.

17. The squeegee assembly as claimed in claim 15, wherein a drive shaft driven by the servomotor extends through the slotted link in the holding fixture and is connected to the bevel gear, and a spindle of the spindle gear is connected to the holding fixture and to the bevel gear.

18. The squeegee assembly as claimed in claims 14, wherein the actuator for adjusting the carriage includes a synchronization shaft extending along the carriage between the carriage ends.

19. The squeegee assembly as claimed in claim 18, wherein the synchronization shaft is arranged within the U-shaped profile of the carriage.

20. The squeegee assembly as claimed in claim 1, further comprising:

a holding fixture at each end of the carriage, wherein each end of the carriage is supported in a slotted link of its respective holding fixture.

21. The squeegee assembly as claimed in claim 1, further comprising:

a clamping device, wherein the squeegee is held on the carriage by the clamping device, and the clamping device is actuated by at least one of the at least one pressure cylinders.

22. The squeegee assembly as claimed in claim 21, wherein when the at least one of the at least one pressure cylinders is in an extreme position, a clamping lever of the clamping device strikes a limit stop on the carriage.

23. The squeegee assembly as claimed in claim 22, wherein the clamping lever is configured as a double-armed toggle lever.

24. Squeegee assembly as claimed in claim 23, wherein, when the at least one of the at least one pressure cylinders is retracted into the carriage, the toggle lever is pushed into a release position by the limit stop.

25. A screen printing machine, comprising:

a printing table;

a squeegee assembly, the squeegee assembly including a squeegee;

a squeegee holder;

a carriage displaceable across the printing table; and at least one pressure cylinder carried on the carriage, wherein the squeegee is held on the carriage by the squeegee holder, each of the at least one pressure cylinders is arranged to press the squeegee against the printing table, the carriage has a U-shaped profile, electrical and/or pneumatic lines are arranged within the U-shaped profile, and at least the cylinder section of each of the at least one pressure cylinders is accommodated within the U-shaped profile, further comprising:

an actuator for at least one of pivoting and limiting a stroke of the squeegee arranged within the U-shaped profile section.

* * * * *

UNITED STATES PATENT AND TRADEMARK OFFICE

CERTIFICATE OF CORRECTION

PATENT NO. : 7,503,255 B2
APPLICATION NO. : 11/402809
DATED : March 17, 2009
INVENTOR(S) : Dietmar Weber et al.

It is certified that error appears in the above-identified patent and that said Letters Patent is hereby corrected as shown below:

Title page,

Item [30], Foreign Application Priority Data, should read:

May 2, 2005 (DE) 20 2005 007 281.8

Signed and Sealed this

Eleventh Day of August, 2009

David J. Kappos

David J. Kappos
*Director of the United States Patent and Trademark Office*